US006032003A

United States Patent [19]

Tatsumi et al.

[11] Patent Number: 6,032,003

[45] Date of Patent: Feb. 29, 2000

[54] MONOCOMPONENT DEVELOPMENT APPARATUS

[75] Inventors: Hiroshi Tatsumi, Shiki-gun; Tetsuro Toyoshima, Kyoto; Takashi Sakai, Kitakatsuragi-gun, all of Japan

[73] Assignee: Sharp Kabushiki Kaisha, Osaka, Japan

[21] Appl. No.: 09/174,008

[22] Filed: Oct. 16, 1998

[30] Foreign Application Priority Data

Oct. 17, 1997 [JP] Japan ..... P9-285382

[51] Int. Cl.[7] ..... G03G 15/06

[52] U.S. Cl. ..... 399/55; 399/285

[58] Field of Search ..... 399/55, 56, 285

[56] References Cited

U.S. PATENT DOCUMENTS

| | | | |
|---|---|---|---|
| 4,466,732 | 8/1984 | Folkins | 399/56 |
| 5,138,385 | 8/1992 | Toyoshi et al. | 399/88 |
| 5,214,477 | 5/1993 | Hirobe et al. | 399/27 |
| 5,262,828 | 11/1993 | Oka et al. | 399/55 |
| 5,761,589 | 6/1998 | Kido et al. | 399/284 |

FOREIGN PATENT DOCUMENTS 457079A 12/1992 Japan .

*Primary Examiner*—Fred L. Braun

[57] ABSTRACT

A switching element and a protective resistance are connected between a developing roller and a developing bias source. A switching element switches on and off a connection between the developing roller and the developing bias source. A protective resistance is connected to the switching element in series. There is a controller and a bias stabilizer. The controller switches on the switching element when a developing bias voltage is to be applied to the developing roller and switches off the switching element when the developing roller is caused to be in an electrically floating state without applying the developing bias voltage, and which bias stabilizer is disposed between the developing roller and a ground and maintains a predetermined stable voltage only when the switching element is switched on. The structure enables a high-quality image to be formed with a low power consumption.

7 Claims, 4 Drawing Sheets

MONOCOMPONENT DEVELOPMENT APPARATUS

BACKGROUND OF THE INVENTION

1. Field of the Invention

The present invention relates to a monocomponent type developing apparatus which is applicable for example to copying machines, printers, and facsimile apparatuses for forming an image by electrophotography, specifically, to a reversal-development type developing apparatus for performing reversal development of an electrostatic latent image by causing a toner support member to contact to an electrostatic latent image support member, while causing a developing bias source to apply a developing bias voltage to the toner support member, and supplying charged toner held by the toner support member to the electrostatic latent image support member.

2. Description of the Related Art

Conventionally, in a dry developing apparatus for developing an electrostatic latent image of an electrophotographic-type image forming apparatus is widely used a two-component developing method using a developer composed of toner and carrier. A typical two-component developing method is a magnetic-brush developing method of erecting the carrier by magnetic field generating means and performing development with the use of toner held on the surface of the carrier.

Although this magnetic-brush developing method using toner and carrier is sufficiently practical, a monocomponent developing method has been widely studied recently, because a downsized development apparatus is increasingly required and maintenance is facilitated in a monocomponent developer which is composed of toner only.

An example of a developing apparatus using a monocomponent developer is shown in FIG. 5. The developing apparatus shown in FIG. 5 is equipped with a photoreceptor 51 serving as an electrostatic latent image support member, a developing roller 52 serving as a toner support member which is disposed so as to face to the photoreceptor 51 and capable of conveying toner while the toner deposits onto a surface thereof, a developer control member 54 for controlling toner held on the developing roller 52 and forming the toner into a thin layer, a toner supply roller 53 for supplying toner to the developing roller 52, a case 55 for storing toner 56 to be supplied to the developing roller 52, a developing bias source 57 for applying a developing bias voltage to the developing roller 52, and a supplying bias source for applying a supplying bias voltage to the toner supply roller.

The toner supply roller 53 rotates in contact with or in proximity to the developing roller 52, whereby the toner 56 stored in the case 55 is stably supplied to the developing roller 52 and an even and thin layer is formed by the developer control member 54. The thin-layered toner 56 is conveyed by a rotation of the developing roller 52 to a developing region where the developing roller 52 and the photoreceptor 51 contact and face to each other, and in this developing region, the toner 56 transfers to an electrostatic latent image on the photoreceptor 51, whereby the image is visualized.

In this monocomponent type developing apparatus, in order to increase a performance in toner supply, it is better to apply a bias voltage to the developing roller 52 and the toner supply roller 53, respectively, which bias voltage generates an electric field in a direction that the toner 56 is supplied from the toner supply roller 53 to the developing roller 52, than to apply a bias voltage of the same potential with the developing roller 52 to the toner supply roller 53. In other words, when the toner is positively charged, an excellent performance in toner supply is obtainable by causing the supplying bias voltage applied to the toner supply roller 53 to be larger than the developing bias voltage applied to the developing roller 52. On the contrary, when the toner is negatively charged, an excellent performance in toner supply is obtainable by causing the developing bias voltage to be larger than the supplying bias voltage.

In the above-mentioned monocomponent type developing apparatus, when the developing apparatus is activated in a state that the developing roller 52 holding toner is halted in contact with the photoreceptor 51 as further shown in FIG. 6, a charger 61 is turned on at the same time that the developing roller 52 and the photoreceptor 51 are rotated, whereby the photoreceptor 51 is uniformly charged by the charger 61. After that, a part which is irradiated by a not-shown exposing device such as LED is discharged and then reversal development of adhering toner to this part is performed.

In this case, on the photoreceptor 51, an uncharged region X is not charged by the charger 61, which uncharged region is formed between the charger 61 and a place where the photoreceptor contacts the developing roller 52 on the downstream side of a direction that the photoreceptor rotates, with the result that a surface potential thereof remains 0 V, that is, uncharged. Even when the developing bias source 57 is turned off and the potential of the developing roller 52 is kept to be 0 V for a time period before the uncharged region X contacts and passes by the developing roller 52, toner held on the developing roller 52 is charged either positively or negatively, so that a potential difference is generated between the toner and the photoreceptor 51 and the toner is likely to deposit on the photoreceptor 51. Furthermore, there arises a problem that, due to a mechanical friction between the toner and the photoreceptor 51, a large quantity of charged toner deposits on the uncharged region X and the toner is wasted.

As means for avoiding the above-said problems, Japanese Unexamined Patent Publication JP-A 4-57079 (1992) discloses, as shown in FIG. 7, a configuration that a Zener diode 71 is provided as a constant-voltage element between the developing roller 52 and the developing bias source 57 in a direction to block a flow of electric charge induced by the developing roller 52, a polarity of which electric charge is opposite to that of toner.

FIG. 7 shows a developing apparatus which uses negatively charged toner. In a case where the toner is consumed in the uncharged region X on the photoreceptor when development is started, positively charged electric charge whose polarity is opposite to that of the toner is induced by the consumed amount. A flow of the induced positive electric charge in a direction to the developing bias source 57 is blocked by the Zener diode 71.

According to the above-described configuration, the developing roller 52 is kept in an electrically floating state up to a voltage of causing a Zener breakdown, and the positive electric charge is held by the developing roller 52. Therefore, the negatively charged toner is attracted to the developing roller 52 and the toner is not supplied from the developing roller 52 to the uncharged region X on the photoreceptor 51, whereby a waste of toner is restricted.

As described above, according to the configuration that the Zener diode 71 is provided between the developing roller 52 and the developing bias source 57, the developing roller 52 is kept in an electrically floating state up to a voltage of causing a breakdown of the Zener diode 71. However, in FIGS. 6 to 8, there arises a problem that the developing bias voltage varies in a range up to the voltage of causing a breakdown of the Zener diode 71 when reversal development is performed.

Further, JP-A 4-57079 discloses a configuration that, in order to solve the above-said problem, conducting means 83 is provided as shown in FIG. 8 for causing the Zener diode 71 to break down and to be in a conducting state when the developing bias voltage is applied, whereby a stable developing bias voltage can be obtained even when reversal development is performed.

However, in either of the above configurations, it is necessary to use a Zener diode of a high breakdown voltage, in order to reliably realize the floating state.

Further, in a case where the Zener diode 71 is kept in a conducting state by the conducting means 83 as shown in FIG. 8, the sum of a difference of potentials given to both ends of a protective resistance 82 which forms the conducting means 83 and a forward voltage of a diode 81 is regarded as the developing bias voltage.

Therefore, there is a problem that, in a case where it is necessary to set the developing bias voltage to be high for the purpose of, for example, increasing an image density, a resistance of a high resistance to pressure is needed as the protective resistance 82. Furthermore, since the Zener diode 71 of a high breakdown voltage is used in order to reliably realize the floating state, there is a problem that a source with a considerably higher voltage than the developing bias voltage is inevitably needed as the developing bias source 57.

SUMMARY OF THE INVENTION

The present invention was made in view of the above-described problems. An object of the invention is to form a high-quality image by enabling stable supply of a developing bias voltage without a waste of power, preventing toner supply to an uncharged region irrelevant to image forming on a photoreceptor, and realizing stable development.

The invention provides a monocomponent type developing apparatus comprising:

a movable toner support member for holding and conveying charged toner;

a movable electrostatic latent image support member disposed in contact with the toner support member, for holding an electrostatic latent image to be developed with the charged toner conveyed from the toner support member;

a developing bias source for applying a predetermined developing bias voltage to the toner support member;

a switching element for selectively switching on and off an electrical connection between the toner support member and the developing bias source;

a protective resistance connected to the switching element;

controlling means for switching on the switching element in the case of applying the developing bias voltage to the toner support member, and for switching off the switching element in the case of keeping the toner support member in an electrically floating state without applying the developing bias voltage; and bias stabilizing means interposed between the toner support member and a ground, for stabilizing the developing bias voltage when the switching element is on.

Accordingly, when developing operation is not carried out, the switching element is switched off to keep the toner support member in an electrically floating state, so that the normally charged toner is prevented from being wasted in the uncharged region on the electrostatic latent image support member. When developing operation is carried out, the switching element is switched on and the bias stabilizing means is actuated to stably apply the developing bias voltage to the toner support member with the use of an output from the bias stabilizing means. Therefore, stable development can be performed.

In the monocomponent type developing apparatus of the invention it is preferable that the bias stabilizing means includes:

a diode for preventing electric charge from flowing to a ground, which electric charge is induced on the toner support member due to movement of the charged toner from the toner support member to the electrostatic latent image support member; and a Zener diode for stabilizing the developing bias voltage when the switching element is switched on, the Zener diode being connected to the diode in series so that an anode or cathode of the Zener diode is connected to an anode or cathode of the diode, respectively.

Accordingly, the bias stabilizing means can be formed in a simple configuration by using the diode and the Zener diode, and it is possible to prevent toner supply to the uncharged region and to realize stable supply of the developing bias voltage.

In the monocomponent type developing apparatus of the invention, it is preferable that when developing operation is carried out, the controlling means controls the switching element to be switched on after a predetermined time delay from a time of start of driving the toner support member.

Accordingly, the controlling means can be realized in a simple manner of control of switching on the switching element after a predetermined time delay from a start signal for starting to drive the toner support member in a reversal development operation. As a result, without disposing a complicated control circuit, it is possible to prevent toner supply to the uncharged region and to realize stable supply of the developing bias voltage.

The invention provides a monocomponent type developing apparatus comprising:

a movable toner support member for holding and conveying charged toner;

a toner supply roller disposed so as to face to the toner support member, for supplying toner to the toner support member;

a movable electrostatic latent image support member disposed in contact with the toner support member, for holding an electrostatic latent image to be developed with the charged toner conveyed from the toner support member;

a bias source for applying a predetermined developing bias voltage to the toner support member and applying a predetermined supplying bias voltage to the toner supply roller;

a switching element for selectively switching on and off an electrical connection between the toner support member and the bias source;

a protective resistance connected to the switching element;

controlling means for switching on the switching element in the case of applying the developing bias voltage to the toner support member and applying the supplying bias voltage to the toner supply roller, and for switching off the switching element in the case of keeping the toner support member in an electrically floating state without applying the developing bias voltage and the supplying bias voltage; and bias stabilizing means interposed between the toner support member and a ground, for stabilizing the developing bias voltage and the supplying bias voltage when the switching element is on.

Accordingly, the switching element is switched off to reliably realize the floating state and the bias stabilizing means is actuated only when the switching element is switched on. Therefore, stable supply of the developing bias voltage is enabled without wasting power, toner supply to the uncharged region irrelevant to image forming on the electrostatic latent image support member is prevented, and stable development is realized, whereby a high-quality image can be attained. Furthermore, the potential difference generated at both ends of the protective resistance is applied between the toner supply roller and the toner support member, whereby a performance in toner supply from the toner supply roller to the toner support member can be enhanced.

In the monocomponent type developing apparatus of the invention, it is preferable that when a developing operation is carried out, the controlling means controls the switching element to be switched on after a predetermined time delay from a time of start of driving the toner support member.

Accordingly, the controlling means can be realized in a simple manner of control of switching on the switching element after a predetermined time delay from a start signal for starting to drive the toner support member when a reversal development operation is carried out. As a result, without disposing a complicated control circuit, it is possible to prevent toner supply to the uncharged region, realize stable supply of the developing bias voltage and enhance a performance in toner supply from the toner supply roller to the toner support member.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
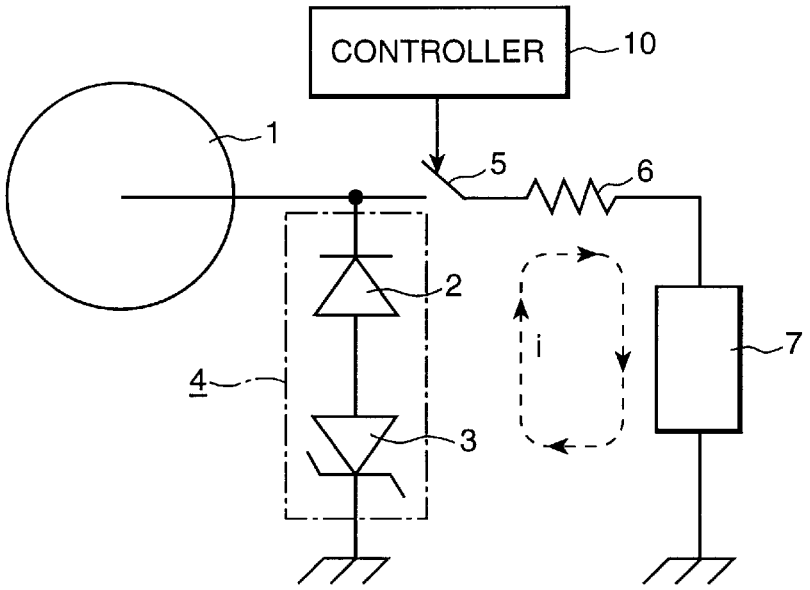
FIG. 1 is a schematic circuit diagram of a first embodiment of monocomponent type developing apparatus according to the present invention.

Now referring to the drawings, preferred embodiments of the invention are described below.

Hereunder, some embodiments of a monocomponent type developing apparatus according to the invention will be described by referring to the drawings.

FIG. 1 is a schematic circuit diagram showing a connection between a developing roller 1 (toner support member) and a developing bias supply 7 according to a first embodiment of the invention, in a monocomponent type reversal developing apparatus using non-magnetic monocomponent toner which is to be negatively charged.

In FIG. 1, one end of a switching element 5 is connected to one end of a protective resistance 6, and the other end of the protective resistance 6 is connected to the developing bias supply 7 which is grounded at its other end. The other end of the switching element 5 is connected to the developing roller 1, as well as to a bias stabilizer 4 which is grounded at its other end.

The bias stabilizer 4 comprises, as shown in FIG. 1, a diode 2 and a Zener diode 3 of which anodes are connected to each other in series. A cathode of the diode 2 is connected to the developing roller 1, and a cathode of the Zener diode 3 is grounded. Alternatively, such a configuration is also possible that the cathodes of the diode 2 and the Zener diode 3 are connected in series, the anode of the Zener diode 3 is connected to the developing roller 1, and the anode of the diode 2 is grounded.

Figure 6:
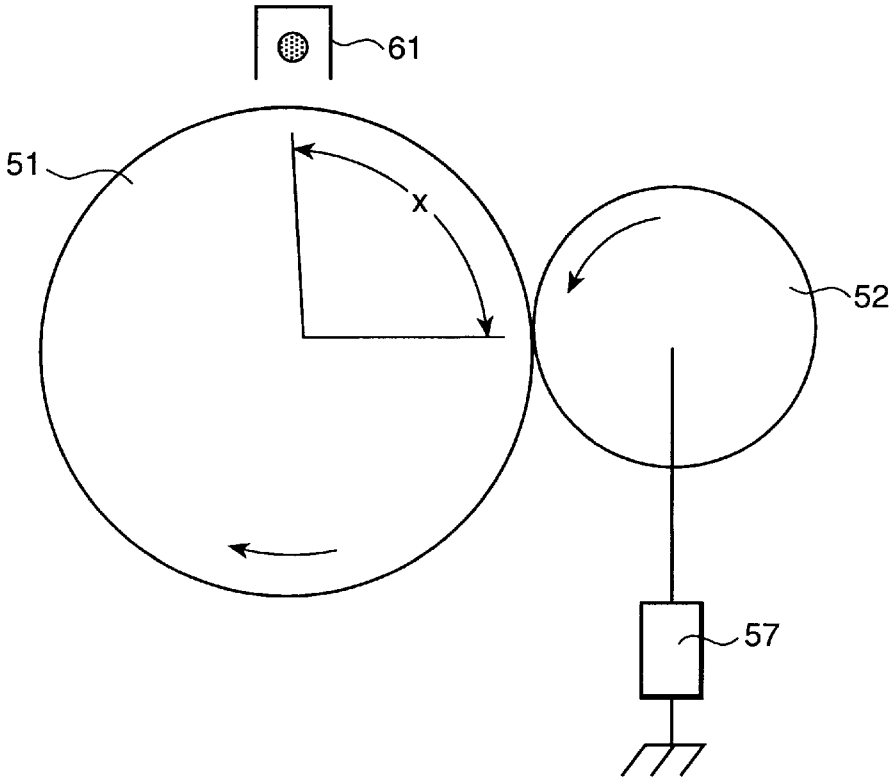
FIG. 6 is a diagram for explaining an uncharged region X on a photoreceptor at the start of reversal development in the monocomponent type developing apparatus.
Figure 7:
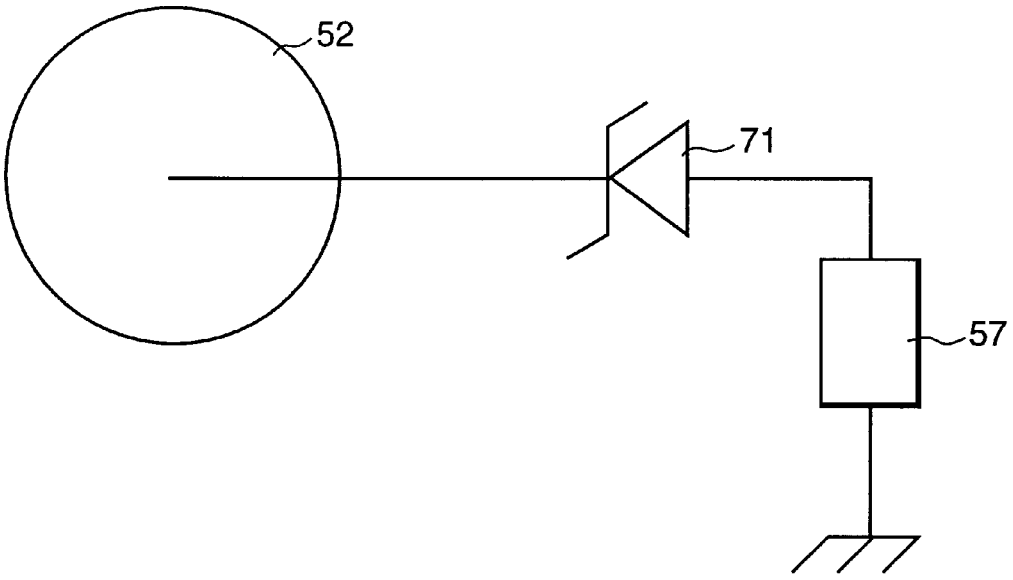
Fig. 7 (PRIOR ART)
FIG. 7 is a schematic circuit diagram showing an example of a conventional developing apparatus.
Figure 8:
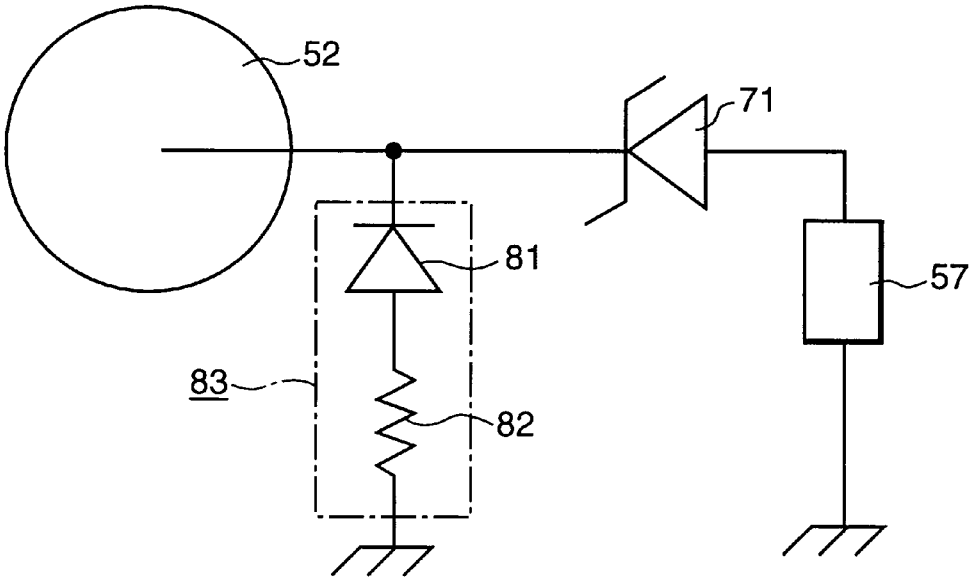
Fig. 8 (PRIOR ART)
FIG. 8 is a schematic circuit diagram showing another example of the conventional developing apparatus.

At the starting of the monocomponent type reversal developing apparatus having the above configuration, the uncharged region X on the photoreceptor 51 or an electrostatic latent image support member disposed so as to be opposed to the developing roller 1, as shown in FIG. 6, is made into contact with the developing roller 52 holding negatively charged toner, then a part of the negatively charged toner on the developing roller 52 is supplied on the uncharged region X, and after which an electric charge of opposite polarity to the negatively charged toner, that is a positive electric charge is induced on the developing roller 52. Incidentally, the developing roller 52 in FIG. 6 corresponds to the developing roller 1 in FIG. 1.

During the period till the uncharged region X on the photoreceptor 51 contacting with the developing roller 1 has passed the same (that is to say a non-developing period), if a controller 10 turns off the switching element 5, the positive electric charge induced on the developing roller 1 flows neither to the developing bias supply 7 nor to the bias stabilizer 4, but can be held on the developing roller 1. Consequently, the negatively charged toner is attracted to the developing roller 1 with positive polarity and no longer supplied to the photoreceptor.

Since the diode 2 constituting the bias stabilizer 4 operates for preventing the positive charge from flowing to the ground, it may be a Zener diode. With the Zener diode, another effect is achieved for electrically limiting the potential decrease of the developing roller 1 due to the positive charge.

Next, when the uncharged region X enters the image forming region after having passed the developing roller 1 while contacting with the same, the switching element 5 is turned ON by the controller 10. If the switching element 5 is turned ON, the current i from the developing bias supply 7 flows via the grounded parts to the Zener diode 3, the diode 2, the switching element 5, the protective resistance 6 and the developing bias supply 7, as shown in FIG. 1.

As a result, the Zener diode 3 breaks down to generate a certain voltage, and the certain break-down voltage determined by the Zener diode 3 is applied to the developing roller 1, whereby stable reversal development is performed.

The protective resistance 6, in turn, limits the magnitude of the current i flowing into the Zener diode 3 and the magnitude of the current at the time the electric charge having an opposite polarity to the toner built-up on the developing roller side flows into the developing bias supply 7. Therefore, the protective resistance 6 can be a resistance of small power, and the developing bias supply 7 needs to supply a voltage slightly larger than the voltage level obtained by adding the breakdown voltage of the Zener diode 3 and the forward voltage of the diode 2.

Hereunder, a timing of a control signal at which the controller turns ON or OFF the switching element 5 so as to enable or disable the application of the developing bias voltage, will be described.

In the configuration shown by FIG. 6, the photoreceptor 51 is an OPC (organic photo conductor) having a diameter of 60 mm, and rotates at a peripheral velocity of 200 mm/sec. The surface of the photoreceptor 51 is uniformly charged so as to have a surface potential of −550 V by the charger 61. In this case, a time Tx required for the uncharged region X on the photoreceptor 51 to pass through the developing region where the photoreceptor 51 and the developing roller 1 contacts, is approximately 200 msec.

Figure 2:
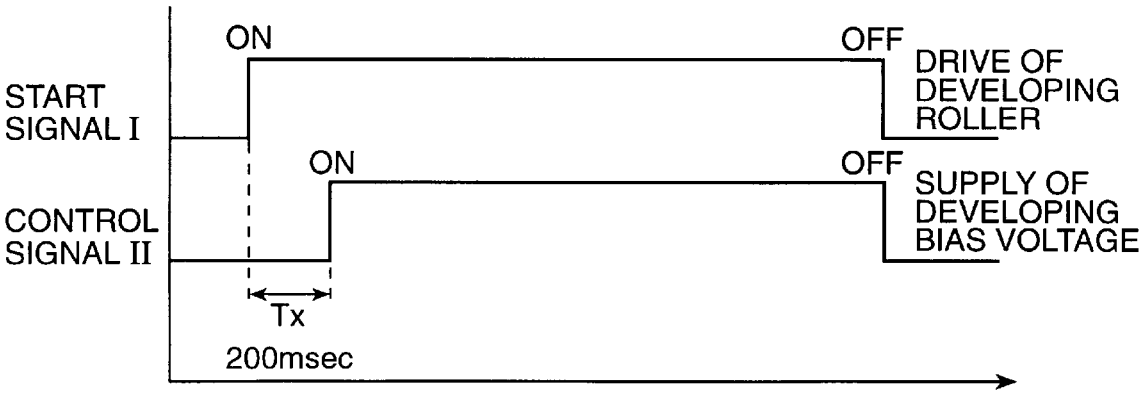
FIG. 2 is a timing chart illustrating an operation of a switching element 5 in FIG. 1.

In other words, as shown in FIG. 2, the controller may be configured so as to output a control signal II which is delayed by the fixed 200 msec time from a start signal I for starting the drive of the developing roller 1 in the reversal development. Consequently, supply of the toner to the uncharged region X is prevented and stable supply of the developing bias voltage is realized without providing a complicated control circuit.

Next, a second embodiment of the monocomponent developing apparatus according to the invention will be described.

Figure 3:
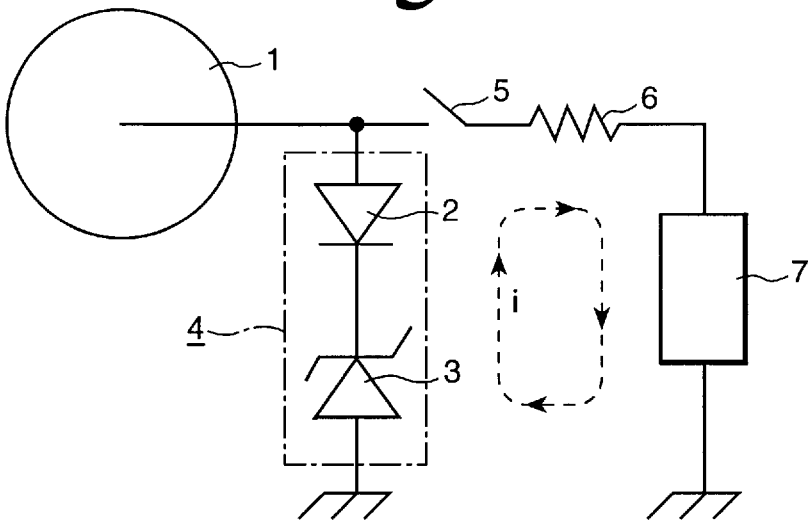
FIG. 3 is a schematic circuit diagram of a second embodiment of the monocomponent type developing apparatus according to the invention.

FIG. 3 is a schematic circuit diagram showing a connection between the developing roller 1 and the developing bias supply 7 which forms a second embodiment of the invention. In this embodiment, non-magnetic toner to be positively charged is used in the monocomponent type reversal developing apparatus.

As shown in FIG. 3, the arrangement of the Zener diode 3 and the diode 2 of the second embodiment is the reverse of that of the first embodiment.

In relation to the bias stabilizer 4 having above-mentioned configuration, under the condition that the positively charged toner is attached to a part of the uncharged region X on the photoreceptor 51, turning OFF the switching element 5 disables a charge generated in the developing roller 1 and having different polarity to the toner to flow into the developing bias supply 7 and the bias stabilizer 4. As a result, the developing apparatus can be made into an electrically floating state.

With the above-mentioned configuration, the positively charged toner is attracted toward the developing roller 1 by means of the negative electric charge held by the developing roller 1, preventing the toner from being attached to the photoreceptor 51 and eliminating waste of the toner.

Furthermore, at the time of the reversal development, the switching element 5 is turned ON for causing the current i to flow from the developing bias supply 7 to the protective resistance 6, the switching element 5, diode 2 and Zener diode 3. A predetermined voltage required as the developing bias voltage can be supplied to the developing roller 1 stably owing to the break-down voltage of the Zener diode 3.

As a result, stable reversal development is realized even if the positively charged non-magnetic monocomponent toner is used.

Next, a third embodiment of the monocomponent type developing apparatus according to the invention will be described. The developing apparatus according to the third embodiment is different from the first and second embodiments in that a potential difference generated between both ends of the protective resistance 6 is utilized as a supplying bias voltage.

Figure 4:
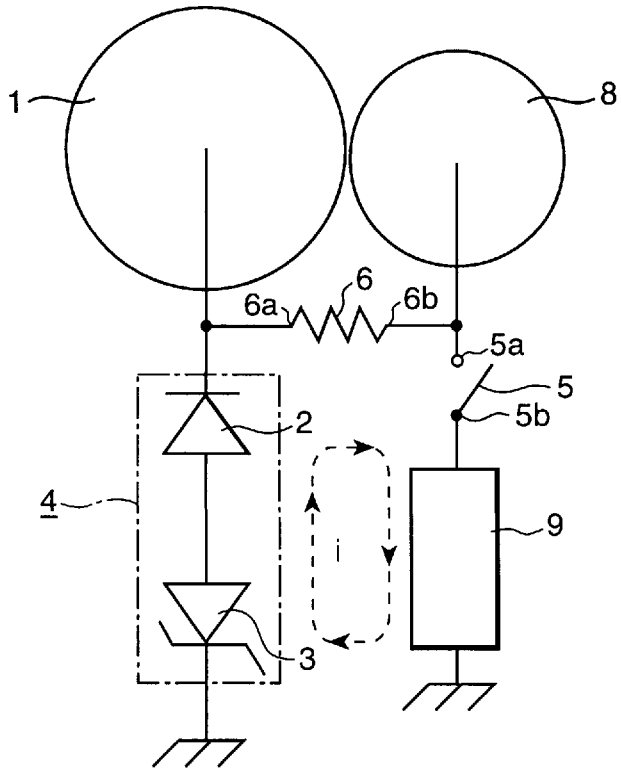
FIG. 4 is a schematic circuit diagram of a third embodiment of the monocomponent type developing apparatus according to the invention.
Figure 5:
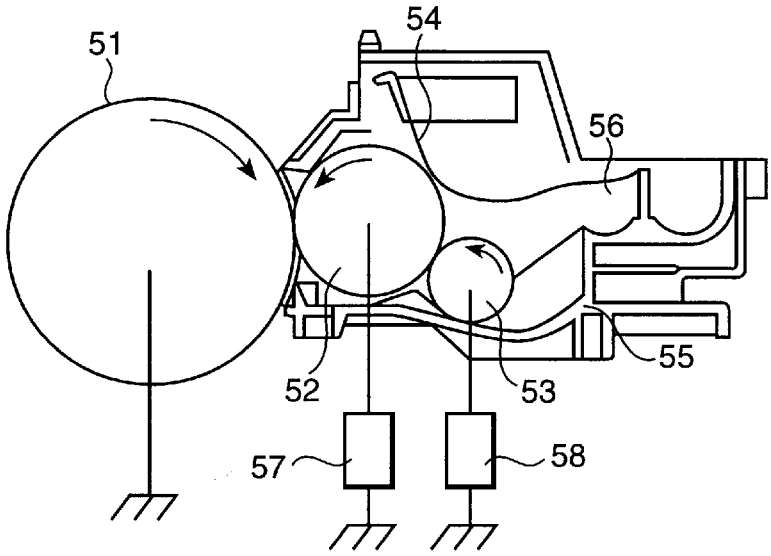
FIG. 5 is a schematic section view of a developing apparatus using non-magnetic monocomponent toner.

FIG. 4 is a schematic circuit diagram showing a connection between the developing roller 1 and the developing bias supply 7 which forms the third embodiment. In this embodiment, non-magnetic monocomponent toner to be negatively charged is used in the monocomponent type reversal developing apparatus.

One end of the bias stabilizer 4 of which other end is grounded, is connected to one end 6*a* of the protective resistance 6 and to the developing roller 1. The other end 6*b* of the protective resistance 6 is connected to the toner supply roller 8 and to one end 5*a* of the switching element 5. The other end 5*b* of the switching element 5 is connected to the bias supply 9 which is grounded at its other end.

Similar to the developing apparatuses of first and second embodiments, the diode 2 constituting the bias stabilizer 4 is directed so that an electric charge induced on the developing roller 1 and having an opposite polarity to that of the charged toner does not flow toward the bias stabilizer 4. The Zener diode 3 is disposed so that when the switching element 5 is turned on, the current i from the bias supply 9 flows in the direction shown in FIG. 3 for causing a predetermined voltage to be generated due to the break-down phenomenon of the Zener diode 3.

Consequently, also in the developing apparatus of third embodiment, the positive electric charge generated on the developing roller 1 flow neither to the bias stabilizer 4 nor the bias supply 9 (in the OFF state of the switching element 5) in starting the developing apparatus. As a result, the positive electric charge is retained on the developing roller 1 and the negatively charged toner is attracted by this positive electric charge, preventing waste of the toner in the uncharged region X on the photoreceptor 51.

Furthermore, when the reversal development is carried out in the developing apparatus, a developing bias voltage of negative polarity is applied to the developing roller 1 by means of the bias stabilizer 4, which enables stable reversal development.

In this embodiment, since the developing roller 1 and the toner supply roller 8 are connected to each end of the protective resistance 6, a voltage drop caused by the current i flowing through the protective resistance 6 is applied to the toner supply roller 8 as the supplying bias voltage, a toner supply performance to the developing roller 1 can be developed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A monocomponent type developing apparatus comprising:

a movable toner support member for holding and conveying charged toner;

a movable electrostatic latent image support member disposed in contact with the toner support member, for holding an electrostatic latent image to be developed with the charged toner conveyed from the toner support member;

a developing bias source for applying a predetermined developing bias voltage to the toner support member;

a switching element for selectively switching on and off an electrical connection between the toner support member and the developing bias source;

a protective resistance connected to the switching element;

a controller for switching on the switching element in the case of applying the developing bias voltage to the toner support member, and for switching off the switching element in the case of keeping the toner support member in an electrically floating state without applying the developing bias voltage; and bias stabilizing means interposed between the toner support member and a ground, for stabilizing the developing bias voltage when the switching element is on.

2. The monocomponent type developing apparatus of claim 1, wherein the bias stabilizing means includes:

a diode for preventing electric charge from flowing to a ground, which electric charge is induced on the toner support member due to movement of the charged toner from the toner support member to the electrostatic latent image support member; and a Zener diode for stabilizing the developing bias voltage when the switching element is switched on, the Zener diode being connected to the diode in series so that an anode or cathode of the Zener diode is connected to an anode or cathode of the diode, respectively.

3. The monocomponent type developing apparatus of claim 1, wherein when developing operation is carried out, the controller controls the switching element to be switched on after a predetermined time delay from a time of start of driving the toner support member.

4. A monocomponent type developing apparatus comprising:

a movable toner support member for holding and conveying charged toner;

a toner supply roller disposed so as to face to the toner support member, for supplying toner to the toner support member;

a movable electrostatic latent image support member disposed in contact with the toner support member, for holding an electrostatic latent image to be developed with the charged toner conveyed from the toner support member;

a bias source for applying a predetermined developing bias voltage to the toner support member and applying a predetermined supplying bias voltage to the toner supply roller;

a switching element for selectively switching on and off an electrical connection between the toner support member and the bias source;

a protective resistance connected to the switching element;

a controller for switching on the switching element in the case of applying the developing bias voltage to the toner support member and applying the supplying bias voltage to the toner supply roller, and for switching off the switching element in the case of keeping the toner support member in an electrically floating state without applying the developing bias voltage and the supplying bias voltage; and bias stabilizing means interposed between the toner support member and a ground, for stabilizing the developing bias voltage and the supplying bias voltage when the switching element is on.

5. The monocomponent type developing apparatus of claim 4, wherein when a developing operation is carried out, the controller, controls the switching element to be switched on after a predetermined time delay from a time of start of driving the toner support member.

6. A monocomponent type developing apparatus comprising:

a movable toner support member for holding and conveying charged toner;

a movable electrostatic latent image support member disposed in contact with the toner support member, for holding an electrostatic latent image to be developed with the charged toner conveyed from the toner support member;

a developing bias source for applying a predetermined developing bias voltage to the toner support member;

a switching element for selectively switching on and off an electrical connection between the toner support member and the developing bias source;

a protective resistance connected to the switching element; and bias stabilizing means interposed between the toner support member and a ground, for stabilizing the developing bias voltage when the switching element is on;

wherein when the switching element is off the development bias voltage is applied to the toner.

7. A monocomponent type developing apparatus comprising:

a movable toner support member for holding and conveying charged toner;

a movable electrostatic latent image support member disposed in contact with the toner support member, for holding an electrostatic latent image to be developed with the charged toner conveyed from the toner support member;

a developing bias source for applying a predetermined developing bias voltage to the toner support member;

a switching element for selectively switching on and off an electrical connection between the toner support member and the developing bias source;

a protective resistance connected to the switching element;

a controller for switching on the switching element in the case of applying the developing bias voltage to the toner support member, and for switching off the switching off the switching element in the case of keeping the toner support member in an electrically floating state without applying the developing bias voltage; and bias stabilizing means interposed between the toner support member and a ground, for stabilizing the developing bias voltage when the switching element is on, wherein the switching element and the protective resistance are connected in series between the toner support member and the developing bias source, and the bias stabilizing means is interposed between the toner support member and the ground, so that the toner support member is brought into a floating state when the switching element is off and the bias stabilizing means is operating when the switching element is on.

* * * * *